US012612683B2

(12) United States Patent
Bordereau et al.

(10) Patent No.: US 12,612,683 B2
(45) Date of Patent: Apr. 28, 2026

(54) FORGED PART OF STEEL AND A METHOD OF MANUFACTURING THEREOF

(71) Applicant: ArcelorMittal, Luxembourg (LU)

(72) Inventors: Victor Bordereau, Montigny-les-Metz (FR); Caroline Persem, Amnéville (FR); Mathieu Lhuillery, Hagondange (FR)

(73) Assignee: ArcelorMittal, Luxembourg (LU)

( * ) Notice: Subject to any disclaimer, the term of this patent is extended or adjusted under 35 U.S.C. 154(b) by 563 days.

(21) Appl. No.: 17/777,163

(22) PCT Filed: Nov. 18, 2019

(86) PCT No.: PCT/IB2019/059868

§ 371 (c)(1),
(2) Date: May 16, 2022

(87) PCT Pub. No.: WO2021/099815

PCT Pub. Date: May 27, 2021

(65) Prior Publication Data

US 2022/0403487 A1 Dec. 22, 2022

(51) Int. Cl.

| | |
|---|---|
| ***C22C 38/04*** | (2006.01) |
| ***C21D 7/13*** | (2006.01) |
| ***C22C 38/00*** | (2006.01) |
| ***C22C 38/02*** | (2006.01) |
| ***C22C 38/06*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/60*** | (2006.01) |

(52) U.S. Cl.

CPC ..... *C22C 38/04* (2013.01); *C21D 7/13* (2013.01); *C22C 38/001* (2013.01); *C22C 38/002* (2013.01); *C22C 38/005* (2013.01); *C22C 38/008* (2013.01); *C22C 38/02* (2013.01); *C22C 38/06* (2013.01); *C22C 38/44* (2013.01); *C22C 38/46* (2013.01); *C22C 38/48* (2013.01); *C22C 38/50* (2013.01); *C22C 38/60* (2013.01); *C21D 2211/005* (2013.01); *C21D 2211/009* (2013.01)

(58) Field of Classification Search

CPC ..... C22C 38/04; C22C 38/001; C22C 38/002; C22C 38/005; C22C 38/008; C22C 38/02; C22C 38/06; C22C 38/44; C22C 38/46; C22C 38/48; C22C 38/50; C22C 38/60; C22C 38/00; C22C 38/42; C22C 38/54; C21D 7/13; C21D 2211/005; C21D 2211/009; C21D 6/002; C21D 6/004; C21D 6/005; C21D 6/02; C21D 9/30; C21D 8/0247

See application file for complete search history.

(56) References Cited

U.S. PATENT DOCUMENTS

| | | | |
|---|---|---|---|
| 6,083,455 | A | 7/2000 | Kurita et al. |
| 2004/0000360 | A1 | 1/2004 | Suzuki et al. |
| 2006/0102257 | A1 | 5/2006 | Arndt et al. |
| 2010/0186855 | A1 | 7/2010 | Diederichs et al. |
| 2010/0186856 | A1 | 7/2010 | Williams et al. |
| 2015/0232972 | A1 | 8/2015 | Park et al. |
| 2016/0032431 | A1 | 2/2016 | Kobayshi et al. |
| 2018/0305798 | A1 | 10/2018 | Teramoto et al. |
| 2019/0338385 | A1 | 11/2019 | Pipard et al. |
| 2019/0345590 | A1 | 11/2019 | Barges et al. |
| 2021/0032733 | A1 | 2/2021 | Teramoto et al. |
| 2024/0368745 | A1 | 11/2024 | Pipard et al. |

FOREIGN PATENT DOCUMENTS

| | | | | |
|---|---|---|---|---|
| CN | 101338398 | A | 1/2009 | |
| CN | 102405300 | A | 4/2012 | |
| CN | 105102659 | A | 11/2015 | |
| CN | 110088320 | A | 8/2019 | |
| CN | 110088325 | A | 8/2019 | |
| CN | 110088342 | A | 8/2019 | |
| EP | 2246451 | A1 | 11/2010 | |
| EP | 3168319 | A1 * | 5/2017 | ..... C21C 7/064 |
| JP | H10235447 | A | 9/1998 | |
| JP | H11152542 | A | 6/1999 | |
| JP | 2005133155 | A | 5/2005 | |
| JP | 2007211314 | A | 8/2007 | |
| JP | 2008240130 | A | 10/2008 | |
| JP | 2012041601 | A | 3/2012 | |
| JP | 2017057475 | A | 3/2017 | |
| WO | WO2017213166 | A1 | 12/2014 | |
| WO | WO2019203348 | A1 | 10/2019 | |

OTHER PUBLICATIONS

Search Report of PCT/IB2019/059868 dated May 29, 2020.
Written Opinion of PCT/IB2020/059868.

* cited by examiner

*Primary Examiner* — Adil A. Siddiqui
(74) *Attorney, Agent, or Firm* — Davidson Kappel LLC

(57) ABSTRACT

A steel for forging mechanical parts including the following elements, expressed in percentage by weight 0.2%≤C≤0.5%; 0.8%≤Mn≤1.5%; 0.4%≤Si≤1%; 0.15%≤V≤0.6%; 0.01%≤Nb≤0.15%; 0.01%≤Cr≤0.5%; 0.01%≤P≤0.05%; 0.04%≤S≤0.09%; 0.01%≤N≤0.025%; and can contain one or more of the following optional elements 0%≤Al≤0.05%; 0%≤Mo≤0.5%; 0.01%≤Ni≤0.5%; 0%≤Ti≤0.2%; 0%≤B≤0.008%; 0%≤Cu≤0.5%; the remainder composition being composed of iron and unavoidable impurities caused by processing, the microstructure of said steel comprising 50% to 90% of Pearlite, 10% to 40% of Ferrite, with an optional presence of acicular ferrite between 0% and 2%, a niobium equivalent of 80% or more.

22 Claims, No Drawings

FORGED PART OF STEEL AND A METHOD OF MANUFACTURING THEREOF

The present invention relates to Ferritic-Pearlitic steel suitable for forging mechanical parts of steel for automobiles.

BACKGROUND

Mechanical parts for the automobiles especially for internal combustion engines are generally manufactured by forging. Material for forging inherently faces the problem of an inability to meet the dual requirements of adequate impact toughness having high level yield strength at same time as meeting the demands of the automobile industry for its engines. A further additional and compulsory requirement for these materials is that they must be good in machinability specifically with regard to fracture splitting so that they can be used to manufacture mechanical parts for internal combustion engines such as a crankshaft, cam shaft, connecting rod, etc.

SUMMARY OF THE INVENTION

Therefore, intense Research and development endeavors are put in to develop a material that is good in machinability while having high yield strength that is above 750 MPa with adequate impact toughness.

Earlier research and developments in the field of steels for forging of mechanical parts for internal combustion engines have resulted in several methods for producing high strength and good machinability some of which are enumerated herein for conclusive appreciation of the present invention:

US20100186855 is a patent publication in which the invention relates to a steel and a processing method for high-strength fracture-splittable machine components that are composed of at least two fracture-splittable parts. The steel and method are characterized in that the chemical composition of the steel (expressed in percent by weight) is as follows: $0.40\% \leq C \leq 0.60\%$; $0.20\% \leq Si \leq 1.00\%$; $0.50\% \leq Mn \leq 1.50\%$; $0\% \leq Cr \leq 1.00\%$; $0\% \leq Ni \leq 0.50\%$; $0\% \leq Mo \leq 0.20\%$; $0\% \leq Nb \leq 0.050\%$; $0\% \leq V \leq 0.30\%$; $0\% \leq Al \leq 0.05\%$; $0.005\% \leq N \leq 0.020\%$, the rest being composed of iron and smelting-related impurities and residual matter. The steel of US20100186855 is able to reach a yield strength of 750 MPa but was unable to provide the impact toughness.

EP2246451 is a patent that relates to a hot-forging micro-alloyed steel and hot-rolled steel which are excellent in fracture splitability and machinability and usable for steel components separated for use by fracture-splitting, and to a component made of hot-forged micro-alloyed steel. But the steel of the EP2246451 are not able to provide adequate impact toughness.

It is an object of the present invention to provide a steel for hot forging of mechanical parts, such as connecting rods, that makes it possible to obtain a yield strength of at least 750 MPa, a tensile strength of at least 1030 MPa and an impact toughness of less than or equal to 5 J in at room temperature using V-notched specimens.

The present invention provides a ferrite-pearlite steel suitable for hot forging that simultaneously has:

- a yield strength greater than or equal to 750 MPa and preferably above 770 MPa,
- an ultimate tensile strength greater than or equal to 1030 MPa and preferably above 1040 MPa,

- an impact toughness of less than or equal to 5 J and preferably less than 4.5 J at room temperature.
- a total elongation greater than or equal to 12.0%.

Preferably, such steel is suitable for manufacturing forged steel parts having a cross section up to 50 mm in diameter such as a crankshaft, connecting rod, cam and camshaft without noticeable hardness gradient between forged part skin and heart.

Another object of the present invention is also to make available a method for the manufacturing of these mechanical parts that is compatible with conventional industrial applications while being robust towards manufacturing parameters shifts.

DETAILED DESCRIPTION

Carbon is present in the steel of the present invention from 0.2% to 0.5%. Carbon imparts strength to the steel by forming pearlite and also limits the formation of ferrite to achieve adequate toughness. Carbon also forms precipitates with Vanadium and niobium in form of carbides or carbonitrides. A minimum of 0.2% of carbon is required to reach a tensile strength of 1030 MPa by forming a minimum of 50% pearlite but if carbon is present above 0.5% the tensile strength after hot forging increases over 1200 MPa with a significant risk of hard secondary phases formation such as acicular ferrite, bainite and martensite which will detrimental for machinability of the obtained forged part. The carbon content is advantageously in the range 0.3% to 0.5% and more especially 0.35% to 0.45%.

Manganese is added in the present steel between 0.8% and 1.5%. Manganese provides hardenability to the steel. It is added to the steel to lower the ferrite and pearlite transformation temperature, leading to finer microstructure, especially to a lower cementite interlamellar spacing in the pearlite and to a lower pearlite colony size. It is preferred that manganese content be between 0.9% and 1.3 and more preferably between 0.95% and 1.15%.

Silicon is present in the steel of the present invention between 0.4% and 1%. Silicon imparts the steel of the present invention with strength through solid solution strengthening. Silicon also acts as a deoxidizer. The preferred content is between 0.5% and 0.9% and specifically 0.6% and 0.75% in the steel of the present invention.

Vanadium is a key element for the present invention and its content is between 0.15% and 0.6%. Vanadium is effective in enhancing the strength of steel by precipitation strengthening especially by forming carbides or carbo-nitrides. The lower limit is 0.15% to guarantee a yield strength of 750 MPa. The upper limit is kept at 0.6% as above 0.6% the effect of Vanadium in not beneficial specifically for increasing tensile and yield strength. Moreover, vanadium precipitation in excess diminishes elongation. The preferred limit for vanadium is between 0.2% and 0.5% and more preferably between 0.25% and 0.45%.

Niobium is present in the steel of the present invention between 0.01% and 0.15%. In the present invention, niobium starts forming precipitates at temperature more than 900° C. in the austenite region which limit the austenite grain size growth kinetics and also form nitrides and carbonitrides same as vanadium at temperature less than 900° C., which enhance the steel yield strength of the steel of the present invention. It is not added to a content more than 0.15% wt to prevent the coarsening of niobium precipitates that can act as nuclei for ferrite transformation leading to the occurrence of ferrite in excess in the as-forged microstructure and thus reducing the tensile strength and yield strength beyond the limit. In addition, content of 0.15% or more niobium is also detrimental for steel hot ductility resulting in difficulties during steel casting and rolling. The preferred limit for niobium is between 0.02% and 0.12% more preferably 0.02% and 0.1%

Chromium is present between 0.01% and 0.5% in the steel of the present invention. Chromium addition can refine the pearlite inter-lamellar spacing because chromium decreases the diffusion coefficient of carbon in the austenite. But the presence of Chromium content above 0.5% risks the formation of hard phases and segregation. Further Chromium above 0.5% can also increase the hardenability beyond an acceptable limit. The preferred limit for Chromium is between 0.05% and 0.3% and more preferably between 0.05% and 0.2%.

Phosphorus content of the steel of the present invention is between 0.01% and 0.05%. A minimum of 0.01% wt in phosphorus is needed to ensure a good fracture splitting behavior. Nevertheless, it is not recommended to use a phosphorus content over 0.05% wt as it will be detrimental for the fatigue limit can cause rupture by intergranular interface decohesion. The preferred limit for Phosphorus content is between 0.01% and 0.025%.

Sulphur is contained between 0.04% and 0.09%. Sulphur forms MnS precipitates which improve the machinability and assists in obtaining a sufficient machinability. During metal forming processes such as rolling and forging, deformable manganese sulfide (MnS) inclusions become elongated. Such elongated MnS inclusions can have considerable adverse effects on mechanical properties such as elongation and impact toughness if the inclusions are not aligned with the loading direction. Therefore, sulfur content is limited to 0.09%. A preferable range the content of Sulphur is 0.060% to 0.085% to obtain the best balance between machinability and fatigue limit.

Nitrogen is in an amount between 0.01% and 0.025% in steel of the present invention. Nitrogen is added to enhance the precipitation of Vanadium and Niobium in the form of nitrides or carbo-nitrides. During the cooling after forging Nitrogen traps vanadium and niobium to form nitrides and carbonitrides. A minimum amount of nitrogen that is 0.01% is required to form nitrides or carbonitrides thus enhance significantly the precipitation strengthening of the steel, and as a result, the yield strength. But an amount of nitrogen above 0.025% leads to the risk of gas porosity formation inside the material during the steel solidification. Nitrogen may also form nitrides with aluminum that will limit the austenite grain growth kinetics. Low austenitic grain size leads to low ferrite and pearlite effective grain size and higher yield strength while keeping impact toughness below 5 KV(J) at room temperature due to the pearlite content.

Aluminum is a residual element for the steel of the present invention and is added to deoxidize the steel and also forms precipitates dispersed in the steel as nitrides which prevent the austenite grain growth. But the deoxidizing effect saturates for aluminum content in excess of 0.05%. A content of more than 0.05% can lead to the occurrence of coarse aluminum-rich oxides that deteriorate fatigue limit and machinability. For the present invention, it is suitable to limit Al content to 0.05% and preferably to 0.03%.

Molybdenum is an optional element and may be present between 0% and 0.5% in the present invention. Molybdenum is added to impart hardenability. The preferred limit for molybdenum content is between 0% and 0.2% and more preferably between 0% and 0.1%.

Nickel is an optional element for present invention and contained between 0.01% and 0.5%. Nickel is added into the steel composition to refine the pearlite inter-lamellar spacing because Nickel decrease the diffusion coefficient of carbon in the austenite same as chromium. It is preferred to limit the presence of nickel to 0.2% for economic feasibility, hence the preferred limit is between 0.01% and 0.2%.

Titanium is an optional element and present between 0% and 0.2%. Titanium must be added in as little quantity as possible due to the reason that minimal quantities keep the nitrogen is solid solution, hence available for the precipitation with niobium and vanadium to impart strength to the steel of the present invention. Titanium forms titanium nitrides which impart steel with strength, but these nitrides may form during solidification process, and have a detrimental effect on machinability and fatigue limit. Hence the preferred limit for titanium is between 0% and 0.1% and more preferably between 0% and 0.05%.

Boron is an optional element that can be present between 0 and 0.008%. Boron has no role to play in the steel for the targeted mechanical parts. Boron has an obvious effect on hardenability and may lead to fully ferrite or pearlite microstructure at the end of the forging process.

Copper is a residual element and may be present up to 0.5% due to processing of steel. Until 0.5% copper does not impact any of the properties of steel but over 0.5% the hot workability decreases significantly.

Other elements such as Tin, Cerium, Magnesium or Zirconium can be added individually or in combination in the following proportions by weight: Tin≤0.1%, Cerium≤0.1%, Magnesium≤0.010% and Zirconium≤0.010%. Up to the maximum content levels indicated, these elements make it possible to refine the grain during solidification. The remainder of the composition of the Steel consists of iron and inevitable impurities resulting from processing.

The microstructure of the Steel comprises:

Ferrite is an essential microstructural constituent of the steel of the present invention. Ferrite is present between 10% and 40% by area fraction in the steel of the present invention. Ferrite of the present invention contains both intergranular as well as intra-granular precipitates of Niobium and Vanadium in form of Carbides, Nitrides and/or Carbo-Nitrides which impart strength to the steel of the present invention. Ferrite also imparts elongation to the steel of the present invention. A minimum of 10% of Ferrite is required to ensure an elongation of at least 12.0% while achieving the strength of 1030 MPa but whenever Ferrite is more than 40% the targeted strength is no longer achieved and impact toughness is increased beyond the limit leading to poor the fracture splitting. Ferrite is formed during the cooling step after the hot forging. The preferred limit for ferrite is between 15% and 40%. In a preferred embodiment according to the invention, it is preferred ferrite content of between 25% and 40% and more preferably between 25% and 35% when the carbon content is between 0.2 to 0.4%. In another preferred embodiment it is preferred ferrite content between 15% and 35% when the carbon content is between 0.4% and 0.5%.

Pearlite is present in the steel between 50% and 90% by area fraction. Pearlite is a hard phase in comparison of ferrite and impart the strength to the steel of the present invention. Pearlite of the steel of the present invention has a two-phased lamellar structure comprising of alternating layers of ferrite and cementite wherein the ferrite of the pearlite is strengthened by the inter-granular as well as intra-granular precipitates of Niobium and Vanadium in form of Carbides, Nitrides and/or Carbo-Nitrides. Pearlite is formed during the cooling after forging. However, when Pearlite is present over 90% a detrimental effect on the steel machinability is observed. It is preferred pearlite between 60% and 90% and more preferably between 60% and 85%. In a preferred embodiment according to the invention, it is preferred that pearlite content be between 50% and 75% and more preferably between 60% and 75% when the carbon content is between 0.2 to 0.4%. In another preferred embodiment it is preferred pearlite content between 75% and 90% and more preferably between 75% and 85% when the carbon content is between 0.4% and 0.5%.

The steel of the invention optionally contains Acicular ferrite between 0% and 2%. Acicular Ferrite is not intended to be part of the invention but forms as a residual microstructure due to the processing of steel. The content of acicular ferrite must be kept as low as possible and must not exceed 2%.

To obtain the targeted mechanical properties especially yield strength and tensile strength, the niobium equivalent must be 80% or more, meaning that the amount of niobium present as carbides, nitrides and/or carbo-nitrides is equivalent to at least 80% of the nominal niobium content present in the steel. It is preferred the niobium equivalent above 90% and more preferably above 95%.

Additionally, the steel of the present invention in its preferred embodiments can have a vanadium equivalent of at least 60% meaning that the amount of vanadium present as carbides, nitrides and/or carbo-nitrides is equivalent to at least 60% of the nominal vanadium content present in the steel. When such vanadium equivalent level is reached, the mechanical properties, specifically tensile strength and yield strength, are improved.

In addition to the above-mentioned microstructure, the microstructure of the mechanical forged part is free from microstructural components such as bainite, Martensite and Tempered Martensite.

A mechanical part according to the invention can be produced by any suitable hot forging process, for example drop forging, press forging, upset forging and roll forging, in accordance with the stipulated process parameters explained hereinafter.

A preferred exemplary method is demonstrated herein but this example does not limit the scope of the disclosure and the aspects upon which the examples are based. Additionally, any examples set forth in this specification are not intended to be limiting and merely set forth some of the many possible ways in which the various aspects of the present disclosure may be put into practice.

A preferred method consists in providing a semi-finished casting of steel with a chemical composition according to the invention. The casting can be done in any form such as ingots or blooms or billets which is capable of being forged in parts having a cross section up to 50 mm in diameter.

For example, the steel having the above-described chemical composition is casted in to a bloom and then rolled in form of a bar. This bar can act as a semi-finished product for forging. Multiple rolling steps may be performed to obtain the desired semi-finished product.

To prepare for the forging operation, the semi-finished product can be used directly at a high temperature after rolling or may be first cooled to room temperature and then reheated for hot forging.

The semi-finished product is reheated between temperature 1150° C. and 1300° C. Then the semi-finished is subjected to hot forging above 950° C. and preferably below 1280° C., preferably between 1000° C. and 1280° C. and more preferable temperature for forging is between 1050° C. and 1280° C.

If the reheating temperature of the semi-finished product is lower than 1150° C., excessive load is imposed on forging dies during the subsequent forging operation and, further, the temperature of the steel may decrease below the Ferrite transformation start temperature. The metallurgical transformation under strain can lead to significant change in the obtained microstructure for a given cooling rate or a given chemical composition. As a result, the obtained microstructure will be completely different from the targeted one as will be the mechanical properties. Therefore, the temperature of the semi-finished product is preferably sufficiently high so that hot forging can be completed in the austenitic temperature range. Reheating at temperatures above 1300° C. must be avoided because they are industrially expensive and can lead to the occurrence of liquid areas that will affect the forgeability of the steel.

A final finishing forging temperature (FFT) must be kept above 950° C. to obtain a structure that is favorable to recrystallization and forging. It is necessary to have final forging to be performed at a temperature greater than 950° C., because below this temperature the steel sheet exhibits a significant drop as the forging will be performed below the non-recrystallization temperature of the steel. Steel ductility below the non-recrystallization temperature will be strongly deteriorated. It can lead to issues regarding the final dimension of the forged part as well as a deterioration of the surface aspect. It can even provoke cracks or a full failure of the forged parts After the hot forging the hot forged steel part is obtained and then hot forged steel part is cooled in a three-step cooling process.

In step one of cooling, the hot forged part is cooled from finishing forging temperature to a temperature range between 775° C. and 875° C., herein also referred as T1 at an average cooling rate of 3° C./s or less and preferably of 2.5° C./s or less and more preferably of 2.0° C./s or less. The preferred T1 temperature range is between 775° C. and 825° C. During this step precipitation strengthening also takes place and the precipitates of Niobium and Vanadium forms nitrides, carbides and/or carbo-nitrides. Hot forged steel part may optionally be held at T1 temperature range for 600 seconds or less.

Thereafter from T1, the second step cooling starts wherein the hot forged part is cooled from T1 to a temperature range between 430° C. and 530° C., herein also referred as T2, at an average cooling rate between 0.5° C./s and 2.1° C./s and more preferably between 0.6° C./s and 2.0° C./s. The preferred T2 temperature range is between 475° C. and 525° C. During this step, the austenite will transform into ferrite and pearlite as well as the vanadium forms precipitates in form of carbides, nitrides or carbonitrides.

In the third step, the hot forged part is brought to room temperature from T2 wherein the average cooling rate during the third step is kept at 5° C./s or less and preferably below 4° C./s and more preferably below 2° C./s. These average cooling rates are chosen to perform homogenous cooling across the cross-section of the hot forged part.

After completion of the third step of cooling the forged mechanical part is obtained.

EXAMPLES

The following tests, examples, figurative exemplification and tables which are presented herein are non-restricting in nature and must be considered for purposes of illustration only and will display the advantageous features of the present invention.

Forged mechanical part made of steels with different compositions is gathered in Table 1, where the forged mechanical part is produced according to process parameters as stipulated in Table 2, respectively. Thereafter Table 3 gathers the microstructures of the forged mechanical part obtained during the trials and table 4 gathers the result of evaluations of obtained properties.

TABLE 1

| Steel Sample | C | Mn | Si | V | Nb | Cr | P | S | N | Al | Mo | Ni | Ti |
|---|---|---|---|---|---|---|---|---|---|---|---|---|---|
| A | 0.39 | 1.07 | 0.70 | 0.327 | 0.084 | 0.145 | 0.015 | 0.067 | 0.0175 | 0.004 | 0.018 | 0.078 | 0.002 |
| B | 0.45 | 1.10 | 0.68 | 0.278 | 0.029 | 0.149 | 0.014 | 0.064 | 0.0180 | 0.007 | 0.036 | 0.069 | 0.002 |
| C | 0.43 | 1.09 | 0.67 | 0.276 | 0.080 | 0.148 | 0.015 | 0.064 | 0.0192 | 0.007 | 0.037 | 0.069 | 0.002 |
| D | 0.41 | 1.07 | 0.70 | 0.330 | 0.029 | 0.145 | 0.014 | 0.070 | 0.0161 | 0.005 | 0.017 | 0.075 | 0.002 |
| E | 0.71 | 0.55 | 0.16 | 0.040 | 0.002 | 0.136 | 0.010 | 0.059 | 0.0121 | 0.003 | 0.022 | 0.081 | 0.002 |
| F | 0.46 | 1.20 | 0.58 | 0.140 | 0.002 | 0.226 | 0.009 | 0.047 | 0.0121 | 0.007 | 0.010 | 0.173 | 0.002 |

underlined values: not according to the invention

Table 2 gathers the process parameters implemented on semi-finished product made of steels of Table 1. The trials I1 to I5 serve for the manufacture of forged mechanical part according to the invention. This table also specifies the reference forged mechanical parts which are designated in table from R1 to R3.

The table 2 is as follows:

TABLE 2

| Trials | Steel Sample | Reheating Temperature (° C.) | FFT (° C.) | CR1 (° C./s) | T1 (° C.) | CR2 (° C./s) | T2 (° C.) | CR3 (° C./s) | T3 (° C.) |
|---|---|---|---|---|---|---|---|---|---|
| I1 | A | 1280 | 1150 | 2 | 800 | 1.0 | 500 | 2 | 20 |
| I2 | A | 1280 | 1200 | 2 | 800 | 0.6 | 500 | 2 | 20 |
| I3 | B | 1280 | 1150 | 2 | 800 | 0.6 | 500 | 2 | 20 |
| I4 | C | 1280 | 1200 | 2 | 800 | 0.6 | 500 | 2 | 20 |
| I5 | D | 1280 | 1150 | 2 | 800 | 1.9 | 500 | 2 | 20 |
| R1 | E | 1280 | 1150 | 2 | 800 | 0.9 | 500 | 2 | 20 |
| R2 | F | 1280 | 1100 | 2 | 800 | 0.9 | 500 | 2 | 20 |
| R3 | B | 1280 | 1150 | 2 | 800 | 2.3 | 500 | 2 | 20 |

I = according to the invention; R = reference; underlined values: not according to the invention.

Table 3 exemplifies the results of the tests conducted in accordance with the standards on different microscopes such as Scanning Electron Microscope for determining the microstructures of both the inventive and reference steels in terms of area fraction. The measurement of Vanadium and Niobium equivalent is based on an electrolytic extraction followed by an optical emission spectroscopy analysis. The selective extraction of precipitates is carried out with an electrolyte made of lithium chloride and salicylic acid salts diluted in methanol. Methanol is preferred to prevent oxidation and ensure an efficient filtration. Steel samples are submitted to a current density that allows only the matrix to dissolve. After this electrolytic operation, the obtained solution is filtered on 200 nm polycarbonate membrane. Thereafter acids mineralisation is performed on the filter and the solution is then analyzed with ICP-OES. The results are stipulated herein:

TABLE 3

| Trials | Pearlite (%) | Ferrite (%) | Acicular Ferrite (%) | Niobium Equivalent (%) |
|---|---|---|---|---|
| I1 | 69 | 31 | 0 | 100 |
| I2 | 67 | 33 | 0 | 100 |

TABLE 3-continued

| Trials | Pearlite (%) | Ferrite (%) | Acicular Ferrite (%) | Niobium Equivalent (%) |
|---|---|---|---|---|
| I3 | 83 | 17 | 0 | 100 |
| I4 | 80 | 20 | 0 | 99.2 |

TABLE 3-continued

| Trials | Pearlite (%) | Ferrite (%) | Acicular Ferrite (%) | Niobium Equivalent (%) |
|---|---|---|---|---|
| I5 | 79 | 19 | 2 | 95.5 |
| R1 | 97 | 3 | 0 | 0 |

TABLE 3-continued

| Trials | Pearlite (%) | Ferrite (%) | Acicular Ferrite (%) | Niobium Equivalent (%) |
|---|---|---|---|---|
| R2 | 92 | 8 | 0 | 0 |
| R3 | 88 | 7 | 5 | 92.4 |

I = according to the invention;

R = reference;

underlined values: not according to the invention.

Table 4 exemplifies the mechanical properties of both the inventive steel and reference steels. To determine the tensile strength, yield strength tensile tests are conducted in accordance of NF EN ISO 6892-1 standards. Tests to measure the impact toughness for both inventive steel and reference steel are conducted in accordance of EN ISO 148-1 standard DVM specimen with V-notch at toom temperature.

The results of the various mechanical tests conducted in accordance to the standards are gathered

TABLE 4

| Trials | YS (MPa) | UTS (MPa) | Impact toughness (J) | T EI (%) |
|---|---|---|---|---|
| I1 | 832 | 1075 | 3.1 | 13.6 |
| I2 | 806 | 1067 | 2.3 | 14.1 |
| I3 | 786 | 1076 | 4.7 | 15.1 |
| I4 | 777 | 1048 | 3.3 | 14.7 |
| I5 | 924 | 1155 | 2.6 | 12.5 |
| R1 | 696 | 1016 | 5.9 | 14.2 |
| R2 | 706 | 1017 | 9.3 | 15.9 |
| R3 | 906 | 1172 | 4.1 | 11.6 |

I = according to the invention;
R = reference;
underlined values: not according to the invention.

What is claimed is:

1. A steel for forging mechanical parts comprising the following elements, the steel having a composition expressed in percentage by weight:

0.2%≤C≤0.5%;
0.8%≤Mn≤1.5%;
0.4%≤Si≤1%;
0.15%≤V≤0.6%;
0.01%≤Nb≤0.15%;
0.01%≤Cr≤0.5%;
0.01%≤P≤0.05%;
0.04%≤S≤0.09%;
0.01%≤N≤0.025%;
and optionally one or more of the following elements
0%≤Al≤0.05%;
0%≤Mo≤0.5%;
0.01%≤Ni≤0.5%;
0%≤Ti≤0.2%;
0%≤B≤0.008%;
0%≤Cu≤0.5%;
0%≤Ce≤0.1%;
0%≤Sn≤0.1%;
0%≤Mg≤0.010%;
0%≤Zr≤0.010%;

a remainder of the composition being composed of iron and unavoidable impurities, a microstructure of the steel comprising 50% to 90% of pearlite, 10% to 40% of ferrite, and optionally acicular ferrite between 0% and 2%, a niobium equivalent being 80% or more, wherein the microstructure is free from bainite, wherein the sheet has an ultimate tensile strength of 1030 MPa or more, a yield strength of 750 MPa or more, and a total elongation of at least 12.0%.

2. The steel as recited in claim 1 wherein the composition includes 0.5% to 0.9% of silicon.

3. The steel as recited in claim 1 wherein the composition includes 0.3% to 0.5% of carbon.

4. The steel as recited in claim 1 wherein the composition includes 0.9% to 1.3% of manganese.

5. The steel as recited in claim 1 wherein the composition includes 0.05% to 0.3% of chromium.

6. The steel as recited in claim 1 wherein the composition includes 0.2% to 0.5% of vanadium.

7. The steel as recited in claim 1 wherein the composition includes 0.02% to 0.12% of niobium.

8. The steel as recited in claim 1 wherein the niobium equivalent is between 90 and 100%.

9. The steel as recited in claim 1 wherein a vanadium equivalent is between 60 and 100%.

10. The steel as recited in claim 1 wherein the pearlite is between 60% and 90%.

11. The steel as recited in claim 1 wherein the ferrite is between 25% and 40%.

12. The steel as recited in claim 1 wherein the sheet has an impact toughness equal to or less than 5 J.

13. The steel of claim 1, wherein the microstructure is free of martensite and tempered martensite.

14. The steel of claim 1, wherein the microstructure consists of 50% to 90% of pearlite, 10% to 40% of ferrite, and optionally acicular ferrite between 0% and 2%.

15. The steel of claim 1, wherein the ferrite contains both intergranular and intragranular precipitates of niobium and vanadium in form of carbides, nitrides and/or carbonitrides.

16. The steel as recited in claim 1 wherein the ferrite is between 25% and 35%.

17. A method of producing forged mechanical parts of the steel as recited in claim 1, the method comprising the following successive steps:

providing in the form of a semi-finished product a steel composition expressed in percentage by weight:
0.2%≤C≤0.5%;
0.8%≤Mn≤1.5%;
0.4%≤Si≤1%;
0.15%≤V≤0.6%;
0.01%≤Nb≤0.15%;
0.01%≤Cr≤0.5%;
0.01%≤P≤0.05%;
0.04%≤S≤0.09%;
0.01%≤N≤0.025%;
and optionally one or more of the following elements
0%≤Al≤0.05%;
0%≤Mo≤0.5%;
0.01%≤Ni≤0.5%;
0%≤Ti≤0.2%;
0%≤B≤0.008%;
0%≤Cu≤0.5%;
0%≤Ce≤0.1%;
0%≤Sn≤0.1%;
0%≤Mg≤0.010%;
0%≤Zr≤0.010%;
a remainder of the composition being composed of iron and unavoidable impurities;
reheating the semi-finished product to a temperature between 1150° C. and 1300° C.;
hot forging the semi-finished productin the austenitic range wherein a finishing hot forging finishing temperature is above 950° C. to obtain a hot forged part;
cooling the hot forged part in a three-step cooling so as to obtain the steel as recited in claim 1, the three-step cooling including:
in step one the hot forged part is cooled at an average cooling rate CR1 of 3° C./s or less from the hot forging finishing temperature to a temperature T1 between 775 and 875° C.,
in step two, the hot forged part is cooled at an average cooling rate CR2 between 0.5° C./s and 2.1° C./s from Tl to a temperature T2 between 430 and 530°° C.,
in step three, the hot forged part is cooled at an average cooling rate CR3 of 5° C./s or less from T2 to room temperature to obtain a forged mechanical part.

18. The method as recited in claim 17 wherein in the step one of cooling the hot forged part is cooled at an average cooling rate less than 2.5° C./s from the hot forging finishing temperature to a T1 temperature range between 775° C. and 825° C.

19. The method as recited in claim 17 wherein in the step two of cooling the hot forged part is cooled at an average cooling rate between 0.6° C./s and 2.0° C./s from Tl to a T2 temperature range between 475° C. and 525° C.

20. The method as recited in claim 17 wherein in step three the hot forged part is cooled at a cooling rate of 4° C./s or less from T2 to room temperature.

21. A method of manufacturing structural or safety parts of a vehicle or an engine comprising utilizing the steel as recited in claim 1.

22. A method of manufacturing structural or safety parts of a vehicle or an engine comprising performing the method as recited in claim 17.

* * * * *